United States Patent [19]

Haselden

[11] 3,931,718

[45] Jan. 13, 1976

[54] REFRIGERANT SCREW COMPRESSION WITH LIQUID REFRIGERANT INJECTION

[75] Inventor: Geoffrey Gordon Haselden, Leeds, England

[73] Assignee: Hall-Thermotank Products Ltd., London, England

[22] Filed: July 17, 1973

[21] Appl. No.: 380,115

Related U.S. Application Data

[63] Continuation of Ser. No. 134,591, April 16, 1971, abandoned.

[30] Foreign Application Priority Data

Apr. 16, 1970 United Kingdom ..... 18289/70

[52] U.S. Cl. ..... 62/505; 62/510; 415/72

[51] Int. Cl.[2] ..... F25B 1/10

[58] Field of Search ..... 62/505, 510, 471, 197; 415/72; 418/201

[56] References Cited

UNITED STATES PATENTS

| | | | |
|---|---|---|---|
| 2,808,225 | 10/1957 | Johnson | 415/72 |
| 2,920,347 | 1/1960 | Joukacher | 415/72 |
| 3,109,297 | 11/1963 | Rinehart | 62/197 |
| 3,129,877 | 4/1964 | Nilsson | 418/201 |
| 3,138,320 | 6/1964 | Schibbye | 418/201 |
| 3,250,460 | 5/1966 | Cassidy et al. | 62/505 UX |
| 3,307,777 | 3/1967 | Schibbye | 418/201 |
| 3,402,571 | 9/1968 | Warner | 62/505 |
| 3,408,828 | 11/1968 | Soumerai et al. | 62/470 |
| 3,422,635 | 1/1969 | Trenkowitz | 62/505 |
| 3,568,466 | 3/1971 | Brandia | 62/510 |

*Primary Examiner*—William E. Wayner
*Attorney, Agent, or Firm*—Dowell & Dowell

[57] ABSTRACT

A screw compressor, compressing refrigerant gas in a refrigeration system, which has liquid refrigerant passed back through it, in counter flow to the gas being compressed, for sealing the rotor clearances. The liquefied gas from the condenser of the system returns to the evaporator either wholly by way of the compressor or partly by way of the compressor as aforesaid and partly through a bypass equipped with an expansion valve.

12 Claims, 1 Drawing Figure

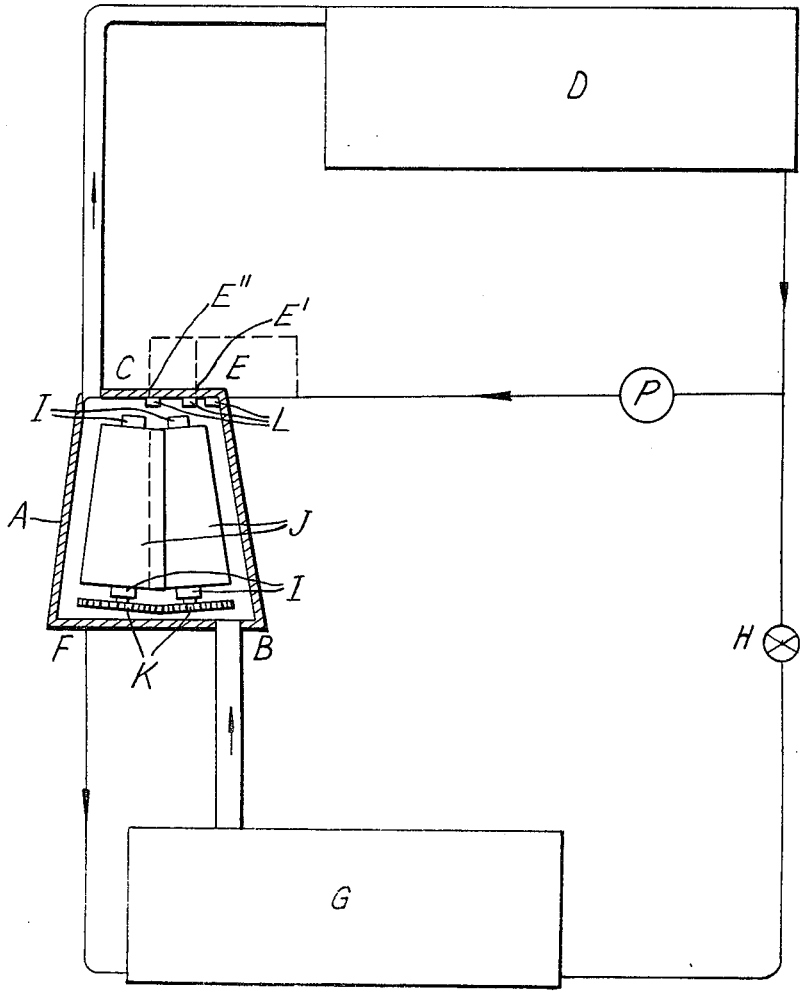
Geoffrey Gordon Haselden
Inventor
By Dowell & Dowell
Attorneys

REFRIGERANT SCREW COMPRESSION WITH LIQUID REFRIGERANT INJECTION

This is a continuation of application, Ser. No. 134,591, filed Apr. 16, 1971, now abandoned.

This invention relates to refrigerating systems in which compressors, and especially screw compressors, are used for compressing refrigerant gas.

A problem encountered with these machines when used for refrigeration purposes has been to seal the clearance spaces between the rotors and between each rotor and the casing in order that the required pressure ratio can be maintained at moderate speeds at a high volumetric efficiency. Another problem is that of removing at least part of the heat of compression in order to reduce power consumption and prevent overheating. One solution has been to inject oil into the machine. This has the disadvantage that a large quantity of oil is required and consequently large oil separators are needed, and the power used in pumping the oil is wasted.

According to the present invention, to maintain a gas seal, at least a proportion of the liquid refrigerant returning from the condenser to the evaporator of the system flows through the compressor in the reverse direction to the gas flow. The liquid can be injected into the compressor at or near the delivery port and the centrifugal force imparted by the moving rotors tends to keep the liquid near the outer peripheries of the rotors. The liquid flows through the clearance towards the low pressure side of the compressor by virtue of the pressure differences across the lobes of the rotors. The clearance can be sized to give the correct liquid flow, and at the same time minimise any gas flow. The clearances may require to be larger at the low pressure end of the machine than at the high pressure end.

One arrangement according to the invention will now be described by way of example and with reference to the accompanying drawing which shows diagrammatically a refrigeration circuit embodying the invention.

In the drawing, a screw compressor A has an inlet for refrigerant in gaseous form at B and an outlet for the compressed gas at C. After the compressed gas has been condensed in a condenser D, at least a proportion of the resulting liquid refrigerant returns to the high pressure side of the compressor at E and, after passing back through this machine, is taken from the low pressure side at F and thence to an evaporator G. The refrigerant liquid regasifies in the evaporator G and is returned to the compressor gas inlet B. Pumps may be required on the liquid lines between the condenser D and the compressor liquid inlet E and between the compressor liquid outlet F and the evaporator G, depending on the relative positions of the circuit components.

Alternatively, counter flow of liquid and vapor could take place in the same pipeline at inlet to the compressor, especially if the different components of the plant are close together. Liquid and gas would then enter and leave the compressor by essentially the same ports and the line leading from F back to the evaporator would be omitted.

Liquid expansion within the compressor is thermodynamically more efficient than if the liquid were expanded externally of the compressor through a throttling valve because the flash gas is recompressed as soon as it is formed without further expansion down to evaporator pressure. In addition, the compressed gas is always at or near the saturation temperature and consequently high temperatures are not developed in the compressor and the wasteful effects of superheat are avoided.

Since one compressor may be required to operate over a range of conditions, control of the liquid flow may be necessary. At high evaporator pressures the mass flow of refrigerant for a given size and speed will be large whilst the pressure difference tending to drive the liquid through the same clearances will be small. As the evaporator pressure drops the refrigerant throughput will go down but the pressure difference across the compressor will rise. Because of this pressure drop it may be necessary to allow some of the liquid flow to the evaporator to take place outside the compressor, using an expansion valve as shown at H. Alternatively, the liquid may be fed into the the compressor at a variable number of entry points E′, E″, or provision may be made for some bypassing of liquid within the compressor itself.

The invention also affords the following further possibilities:

a. The use of liquid refrigerant to cool and lubricate the compressor bearings I; these can be ball-bearings or roller bearings at the ends of the rotors J.
b. The use of the liquid refrigerant to lubricate and/or cool the rubbing surfaces of the rotors in machines where no external gearing is provided. In this case it may be desirable to make the rotors of dissimilar materials of which one would preferably be of a low-friction material; the machine is then less liable to seizure should it temporarily run dry.
c. Where intermeshing rotor gearing K is provided, the bathing of the gears in the refrigerant liquid.
d. In a hermetic design, the irrigation of the motor bearing with liquid refrigerant.
e. The injection of some or all of the liquid going back through the compressor through one or more holes provided in one or both rotors.
f. The control of compressor capacity by the use of variable area porting at the inlet or outlet, or both.
g. The employment of a compressor with double-ended reverse helix rotors. This simplifies the bearing arrangements so that bathing the bearings in liquid refrigerant becomes an adequate means of lubrication.
h. The internal surface of the compressor casing in contact with the refrigerant, rather than being smooth, could be machined or otherwise treated to have a textured surface which would retain liquid refrigerant, and would also reduce the back-flow of liquid under the pressure gradient.
i. The inlet ports to the compressor for the returning liquid refrigerant could comprise plugs L of porous material, such as sintered metal, so that liquid would flow through due to surface tension but reverse flow of vapour would be prevented. This provision will be particularly valuable if multiple liquid entry ports are used and not all of them are exposed to gas at the same pressure at the same time.
j. Part or all of the surface of one or both rotors, or of the casing, can consist of a layer of porous material, such as sintered metal, so that part at least of the liquid refrigerant can flow from the high pressure to the low pressure zones of the compressor through this porous material.

k. The compressor can be mounted with the rotor axes vertical, so that gravity will either aid or oppose the liquid flow, and the clearances designed accordingly.

l. The flow of most or all of the liquid refrigerant from the condenser back through the compressor can still take place in cases where conventional lubricants are used to minimize friction or for partial sealing, provided that the mutual solubility of the lubricant and refrigerant is low. The thermodynamic advantages of multi-stage liquid expansion and cooling will still be obtained.

m. The provision of a number of control valves to regulate the distribution of liquid refrigerant between different injection points in the compressor casing, rotors or both.

What I claim is:

1. A closed cycle refrigeration system, comprising an evaporator receiving liquid refrigerant and gasifying it, a rotary compressor receiving at its inlet side the refrigerant gas from the evaporator and compressing it, a condenser receiving the compressed gas discharged by the compressor and condensing it, means delivering at least a portion of the liquid refrigerant from the condensor outlet back to the discharge side of the compressor, and a second liquid line conducting liquid refrigerant from the inlet side of the compressor back to the evaporator, the liquid refrigerant returned to the compressor in said first liquid line traveling through the compressor to said second liquid line by way of the rotor clearance gaps in the compressor; and means including an expansion valve for delivering the remaining portion of liquid refrigerant from the condensor outlet to the evaporator.

2. A refrigeration system according to claim 1, wherein the compressor is a screw compressor.

3. A refrigeration system according to claim 1, wherein the liquid is injected into the compressor near the compressed gas delivery port and leaves near the gas inlet.

4. A refrigeration system according to claim 1, wherein the clearances within the compressor are larger at the low pressure end of the machine than at the high pressure end.

5. A refrigeration system according to claim 1, wherein counter flow of liquid and gas takes place in the same pipe line at the inlet to the compressor.

6. A refrigeration system according to claim 1, wherein a bypass passage, including said expansion valve, is provided through which a proportion of the liquid from the condenser can flow back to the evaporator without passing through the compressor rotor clearance gaps.

7. A refrigeration system according to claim 1, wherein the liquid is fed into the compressor at a plurality of entry points.

8. A refrigeration system according to claim 1, wherein the liquid inlet port comprises a plug of porous material such as sintered metal.

9. A refrigeration system according to claim 1, wherein the liquid refrigerant is employed to lubricate the bearings of the compressor.

10. A refrigeration system according to claim 1, wherein the compressor rotors are geared to one another and the gears are bathed in the liquid refrigerant.

11. A refrigeration system according to claim 1, wherein the inside of the compressor casing is roughened to retain liquid refrigerant.

12. A process of gas compression in an oil-free refrigeration system wherein a screw compressor draws gas into an inlet on its low-pressure side from an evaporator and delivers compressed gas from a delivery port at its high-pressure side into a condenser, including the steps of withdrawing part of the liquid phase of the gas being compressed from the liquid condensed in the condenser, injecting said withdrawn liquid into the compressor at a pressure point near its delivery port on the high-pressure side of the compressor whereby injected liquid is driven toward the low-pressure side of the compressor by the differential pressure across the compressor and liquid arriving at its inlet port is delivered directly to the evaporator.

* * * * *